United States Patent [19]

Aliprandi et al.

[11] 4,187,965

[45] Feb. 12, 1980

[54] BOX DISCHARGER COMPRISING RELOADABLE REFRACTORY PLATES, WITH WEDGE LOCKING

[75] Inventors: Giovanni Aliprandi; Roberto Ricci; Giovanni Timossi, all of Genoa, Italy

[73] Assignee: SANAC Societa per Azioni Refrattari Argille e Calolini, Italy

[21] Appl. No.: 898,774

[22] Filed: Apr. 21, 1978

[30] Foreign Application Priority Data

Jun. 6, 1977 [IT] Italy ..... 12627 A/77

[51] Int. Cl.[2] ..... B22D 37/00

[52] U.S. Cl. ..... 222/600; 251/187; 251/203

[58] Field of Search ..... 251/187, 203, 204; 222/512, 600, 598, 591

[56] References Cited

U.S. PATENT DOCUMENTS

| | | | |
|---|---|---|---|
| 2,001,094 | 5/1935 | Cuttle | 251/203 |
| 3,760,993 | 9/1973 | Meiev | 222/600 |
| 4,056,217 | 11/1977 | Aliprandi et al. | 222/600 |

FOREIGN PATENT DOCUMENTS

| | | | |
|---|---|---|---|
| 549212 | 11/1942 | United Kingdom | 222/591 |

*Primary Examiner*—David A. Scherbel

*Attorney, Agent, or Firm*—Robert E. Burns; Emmanuel J. Lobato; Bruce L. Adams

[57] ABSTRACT

A box discharger particularly suitable for ladles and the like, of the type comprising reloadable refractory plates and with a wedge locking system, which reduces the operation for positioning the tilting plate with respect to the stationary plate to the adjustment of a single element instead of several elements as required by the present art.

8 Claims, 9 Drawing Figures

BOX DISCHARGER COMPRISING RELOADABLE REFRACTORY PLATES, WITH WEDGE LOCKING

BACKGROUND OF THE INVENTION

The invention relates to a box discharger, particularly suitable for ladles and the like, of the type comprising reloadable refractory plates and with a wedge locking system.

Box dischargers, particularly those intented to be used as intercepting means on the bottom of ladles and the like are generally known.

They consist of an upper plate, firmly fastened against the bottom of the ladle and the like, and a lower plate tiltably connected to said upper plate, so as to allow the insertion of the refractory elements forming part of the discharger.

A slidable plate, suitably controlled by a lever, or better by a jack actuated hydraulically or by compressed air, is arranged between the two plates.

In order to obtain a good seal in the discharger, it is necessary that the refractory elements arranged within the discharger and intended to slide onto each other during the opening and closing motions of the box, may rest perfectly onto each other. The contact conditions are obtained by suitably adjusting the paralelism of the stationary plate and the tilting one with respect to each other.

For this purpose it is known to use four to six bolts which allow an exact positioning of the tilting plate with respect to the stationary one. Obviously, the uniform tightening of said bolts requires calibrated keys and particularly a considerable loss of time.

More recently, according to an applicants' invention, only two bolts have been used instead of four or six for fastening the tilting plate to the stationary one; the two bolts controlling the relative displacement of two wedges arranged laterally to said plates.

However, in this case too, the exact positioning of the tilting plate with respect to the stationary one is obtained through calibrated keys on two distinct bolts.

OBJECTS OF THE INVENTION

In view of the foregoing, the invention aims at adjusting the relative position of the tilting plate with respect to the stationary one by actuating an annular element provided with wedges, whereby the adjustment operation requires to act on a single element.

BRIEF DESCRIPTION OF THE DRAWINGS

In order that the invention may be clearly understood, it will now be described with reference, by way of example, to the accompanying drawings, wherein.

DESCRIPTION OF A PREFERRED EMBODIMENT

Figure 1:
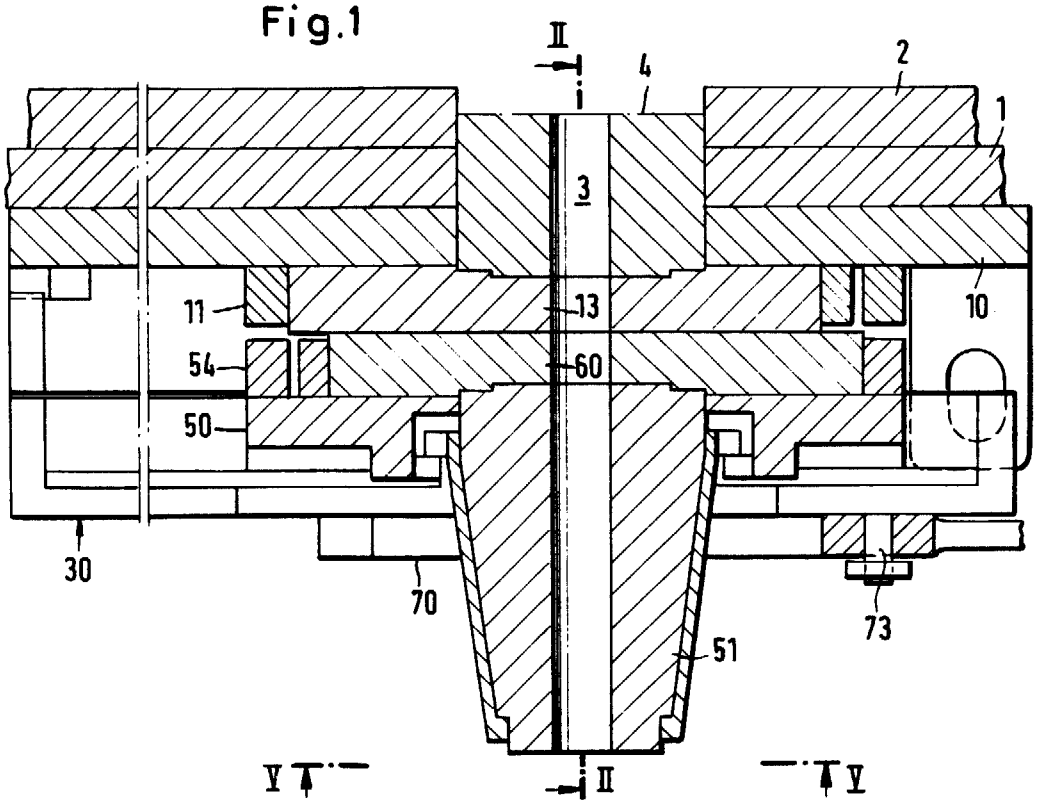
FIG. 1 is a sectional view of a discharger according to the invention, sectioned parallel to the direction of sliding of said sliding plate.
Figure 2:
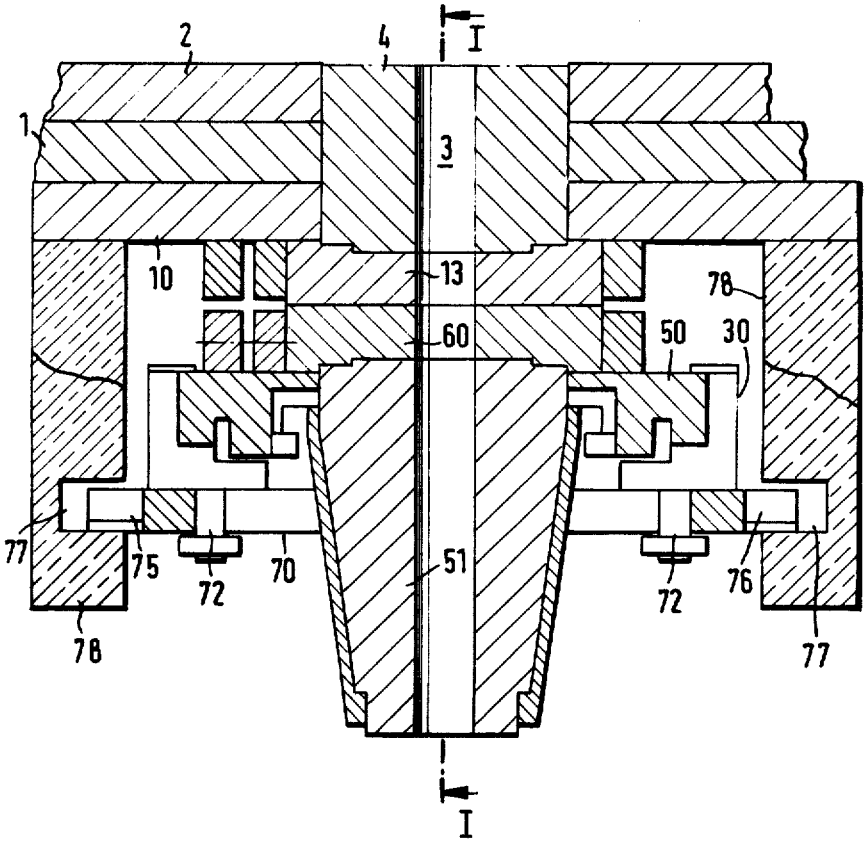
FIG. 2 is a cross section view of the discharger shown in FIG. 1, and both figures relate to section planes passing through the tapping hole of the discharger shown in open position.
Figure 3:
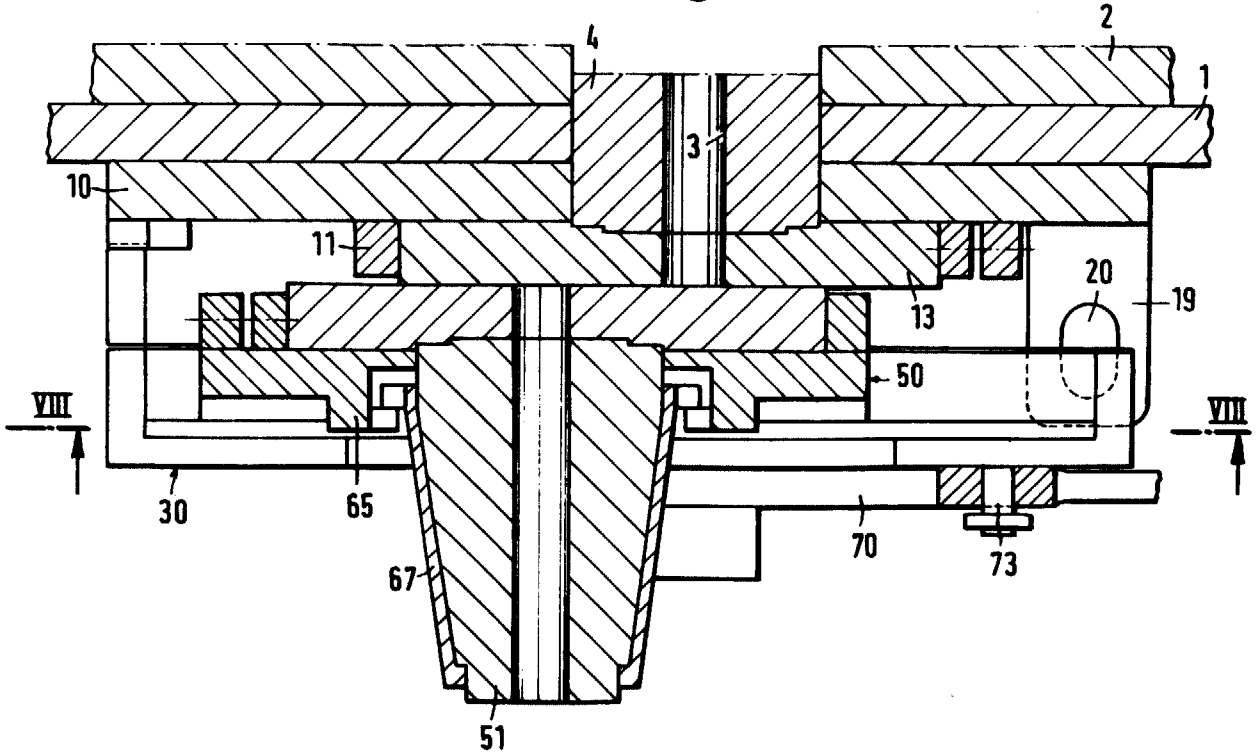
FIG. 3 is a view similar to FIG. 1, illustrating the discharger in a closed position, that is in the position of interception of the tapping hole.

The discharger according to the invention is suitable to be arranged in known manner onto the metal bottom 1 of a ladle or the like coated inside by a refractory coating 2 and shown only partially in the drawings.

Both the metal bottom 1 and the refractory coating 2 comprise a tapping hole 3 arranged at the center of a refractory sleeve 4 passing through the thickness of both the bottom 1 and coating 2; the sleeve may be replaced from outside the ladle.

A stationary or upper plate 10 is fastened in any suitable manner onto the metal bottom 1. The plate 10 is provided with a hole aligned with the holes of the bottom 1 and coating 2, the refractory sleeve 4 which may also project slightly, for a suitable length, over the lower face of the plate 10.

On the lower face of the plate 10 is fastened a frame 11 substantially rectangular (FIG. 7) through screws 12, of which only the position of the axis is shown, the screws are arranged for instance at the corners of the frame.

A flattened brick 13 of refractory material is arranged inside the frame 11, the brick 13 is provided with a central hole 14 aligned to the tapping hole 3 of the sleeve 4 and with the same diameter as the latter.

The thickness of the flatted refractory brick 13 is larger than the thickness of the frame 11 for the reasons described herebelow.

In order to fasten in a safe and exact way the flattened refractory brick 13, the frame 11 comprises inside on two sides not parallel of its, two battens 15 and 16 which, through screws 17 and 18, allows to tighten the flattened refractory brick 13, notwithstanding the unavoidable dimensional tolerances of the latter.

The use of adjusting battens, like the battens 15,16, was already described in a previous patent by the applicants.

Figure 9:
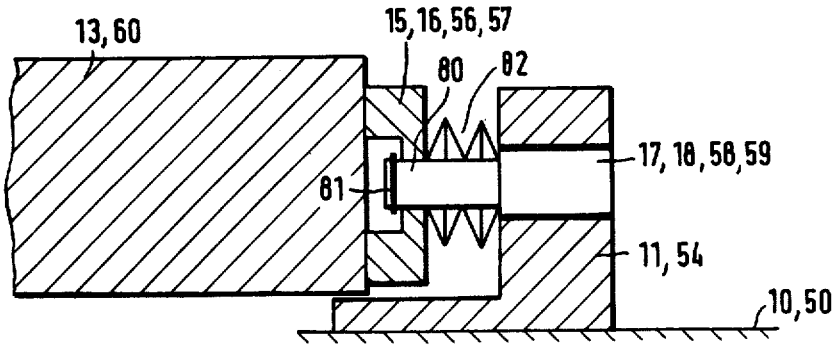
FIG. 9 is an enlarged detail view of FIGS. 1, 3, 2 and 4.

The invention claims, among the other co-ordinated characteristics, the peculiar solution used for the adjusting screws 17 and 18, shown in FIG. 9.

Figure 4:
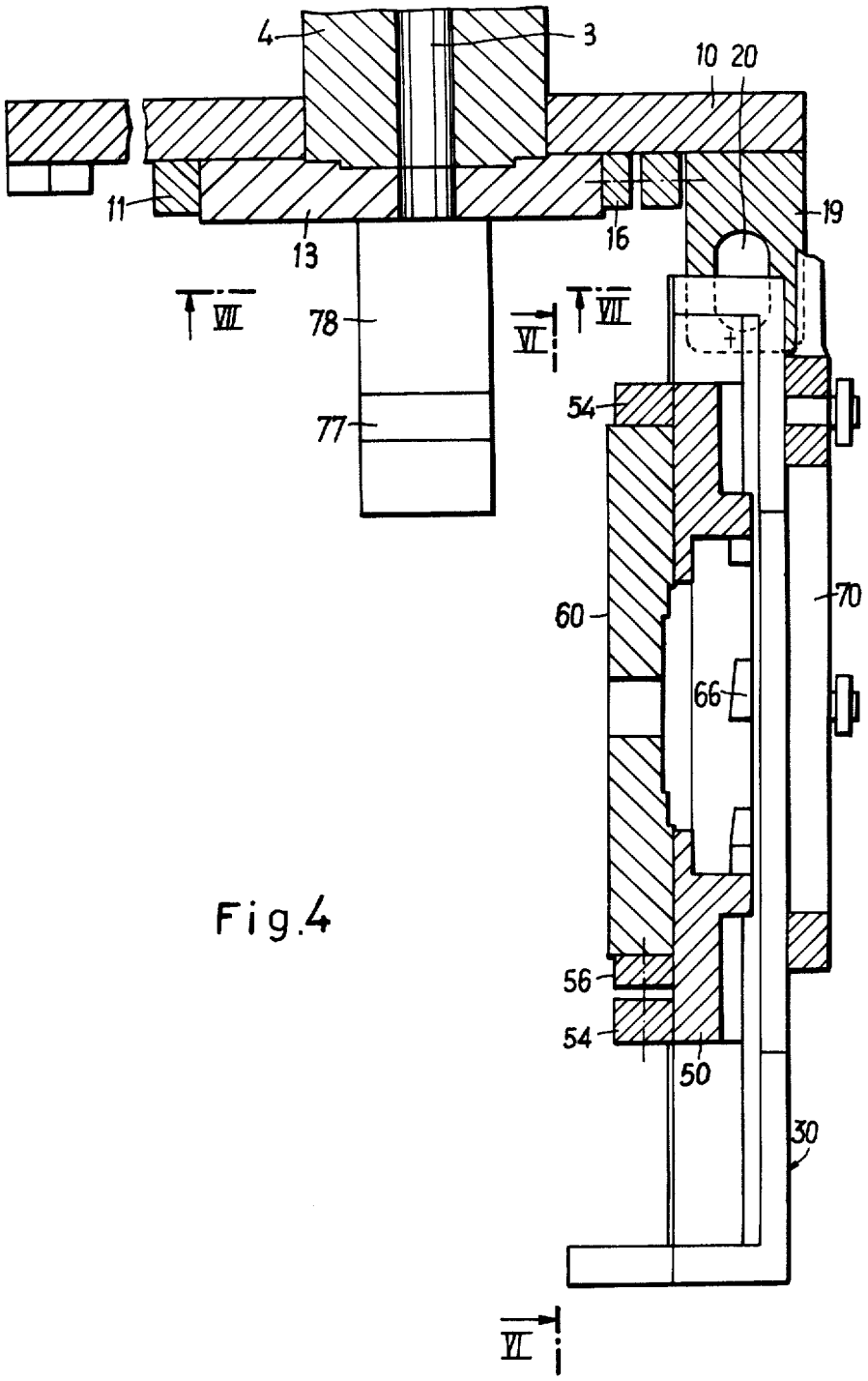
FIG. 4 is a longitudinal section view of the discharger shown in its disassembled position, that is with the lower plate tilted with respect to the upper stationary one, to allow entrance to the refractory elements to be arranged within the discharger.

The screws allow according to the invention, after the tilting plate 30 has been tilted to the position shown in FIG. 4, to reach a frame 12 and remove it from said stationary upper plate 10. In such a way, before it becomes necessary to replace said flattened brick 13, its working surface appearing in FIG. 7 directed towards the watcher may be restored with refractory mortars, so as to remove the effects of wear not regularly distributed.

The possibility of removing from the stationary plate 10 the whole frame 11, allows to perform in the best conditions the delicate operation of restoring the worn out surface of the brick. On the other hand, the stop to the discharger and thus to the ladle for such an operation is limited to the replacement of said frame 11 by another previously prepared frame.

The upper stationary plate 10 comprises in known way at one of the longitudinal ends of the discharger two ears 19 projecting downwards and provided with vertically elongated slits 20. The slit 20 serves for the passage of aligned pins 21; a tilting lower plate 30 being articulated at one end of the pins 21.

The tilting plate 30 is kept in working conditions parallel to the stationary plate 10 and between the two plates is arranged slidably a sliding plate 50 constituting the intercepting means of the discharger.

The tilting plate 30 has substantially the form of a flattened prismatic bow open at the top, with a bottom 31, end sides 32 and longitudinal sides 33.

The bottom 31 comprises two guides 34 for said sliding plate 50 parallel to the longitudinal sides 33. In order to prevent said sliding plate 50 from lifting, for any reason, from said longitudinal guides, the upper edges 35 of the longitudinal sides 33 of plate 30 are covered by catch guides 37 projecting of a suitable length towards the inside of said tilting plate 30, so as to cover partly the longitudinal sides of the tilting plate 30.

Figure 6:
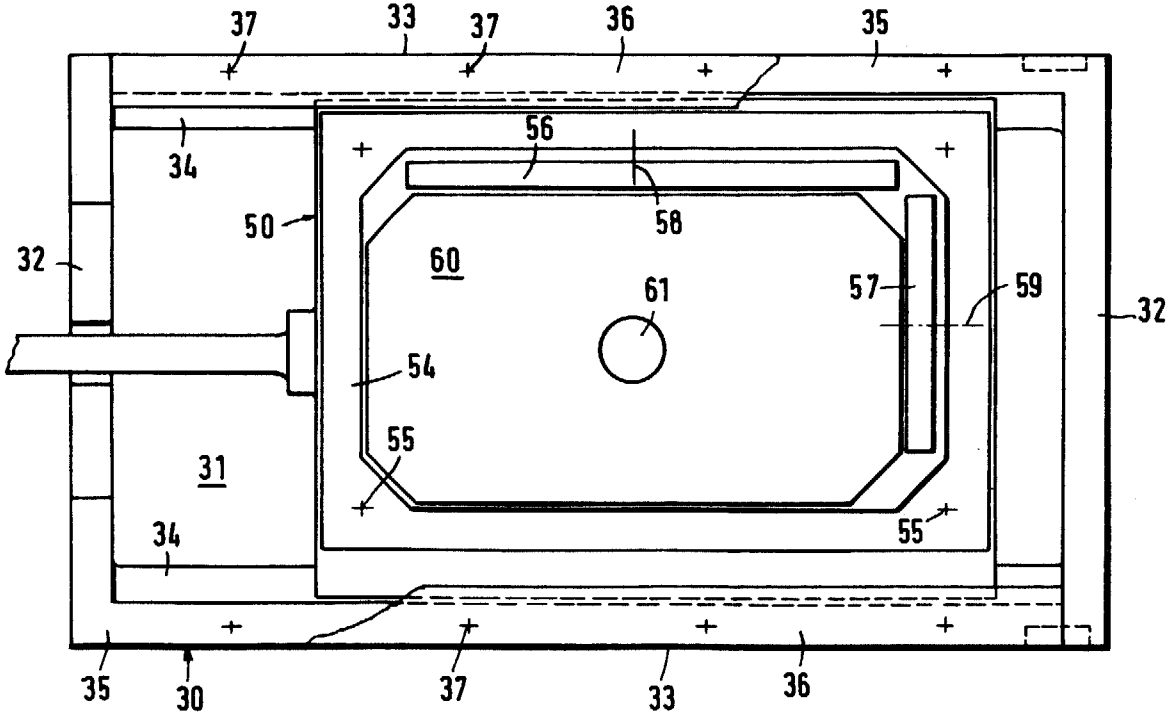
FIG. 6 is a view of the discharger sliding plate along line VI—VI of FIG. 4.

The catch guides 36 are fastened by means of screws 37 of which in FIG. 6 is shown diagrammatically only the position of the relative axis.

As shown in FIGS. 1,2,3,6,8, the sliding plate 50 has a flattened prismatic shape and is provided with a central hole housing the upper end of a tapping sleeve 51 of refractory material. The sliding plate 50 is further provided in known manner with a rod 52, connected to a hydraulic or pneumatic jack through which it controls the positioning of said sliding plate 50 and thus the degree of opening or closing of the discharger. The longitudinal edges 53 of the sliding plate 50 are suitably milled and possibly coated with strips of antiwear material, not shown in the drawings, for guiding the sliding plate 50 against the inner faces of the longitudinal guides 33, against the guide surfaces 34 and the catch guides 36 of the tilting plate 30.

Besides, according to the invention, a rectangular frame 54 fastened by screws 55 and thus disassemblable, is arranged on the upper face of the sliding plate 50. Inside said frame 54 is locked, by means of battens 56,57 and screws 58,59 a second flattened refractory brick 60 provided with a central tapping hole 61 (FIG. 6).

Therefore, what above said about frame 11, stationary plate 10 and relevant accessories, is also valid for said frame 54 of said sliding plate 50.

Therefore, when the discharger is in the position shown in FIG.4, it is possible to disassemble and replace easily either said frame 11 or said frame 54 without losing time.

For a good operation of the box discharger, the opposite surfaces of the flattened refractory bricks 13 and 60 of the upper stationary plate 10, and the sliding plate 50 respectively, may be exactly coplanar and in contact.

To this end, as already said, the box discharger of known type comprises a set of bolts, four to six, having the function of locking in the required relative position the upper stationary plate 10 and lower tilting plate 30 so as to assure on one side a perfect adherence of the opposite faces of bricks 13 and 60, and on the other side so as to allow the relative displacement of said sliding plate 50 between said plates 10 and 30.

As the positioning is very important for a good operation of the discharger, it is clear that the adjustment of the tightening conditions of said four or six bolts requires quite a long time.

According to the invention, the relative positioning is obtained by acting on a single adjusting element that is an annular element 70 provided with wedges and turnable by means of a lever 71 below the lower face of the tilting plate 30.

The rotation of the annular element 70 to a position adjacent to the lower face of said lower plate 30 is obtained, in the example shown in the drawings, by means of three rollers 71 to 73. The first two of the rollers rest against the inner edge of the element 70, while the third has a relative motion, with respect to the element 70, within a groove 74 provided the central zone of the element 70. The rollers have on their top flanges covering partly the surface of the annular element 70.

The ends of the element 70 have, at least in two opposite zones, their outer edges shaped wedge-like (numerals 75 and 76) and suitable to engage horizontal slits 77 provided on the inner face of two uprights 78 projecting from the lower face of the stationary plate 10 on the sides of the tilting plate 30.

The clockwise rotation of the element 70 makes the wedge-like edges 75,76 enter the slits 77 of uprights 78 and that on its turn makes the tilting plate 30 approach the stationary plate 10. As the pins 21 and slits 20 do not obstruct, within given limits, the relative vertical movements of the tilting plate and stationary plate, the refractory bricks 13 and 60 are pushed towards each other.

The anticlockwise rotation of the element 70 until the disengaging of the wedge-like edges 75,76 from the slits 77, allows the tilting plate 30 to tilt with respect to the stationary plate 10 and thus frames 11 and 54 to enter; the refractory bricks 13 and 60 of the frames come so to sight, in view of a possible repairing or replacement as above stated.

The sliding plate 60 is provided in known manner with a lower annular rib 65 comprising on its inner cylindric face teeth 66 of a shift clutch for a metal socket 67 receiving the refractory tapping sleeve 51.

Figure 5:
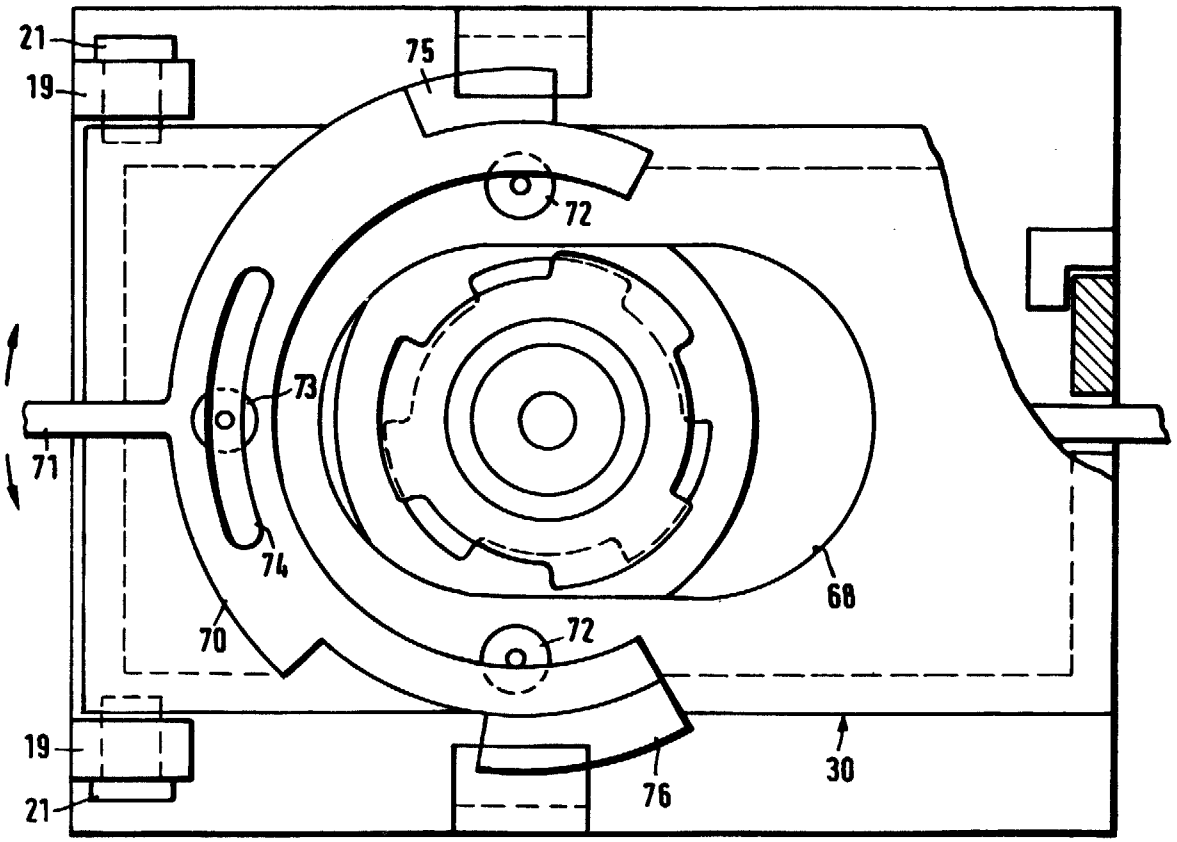
FIG. 5 is a view from below of the discharger with some of its parts removed.

Obviously, as the sleeve 51 moves to the sliding plate, the bottom 31 of the tilting plate 30 is provided with an elongated opening 68 (FIG. 5).

Figure 7:
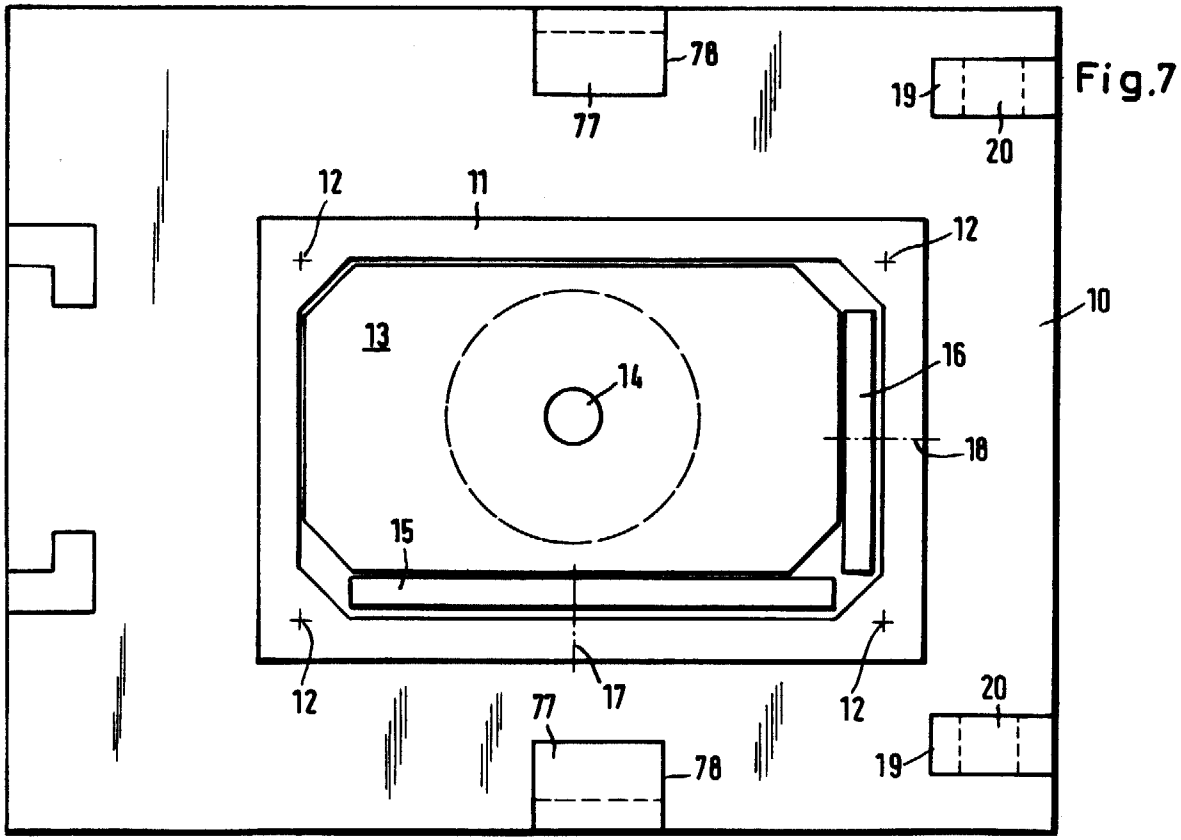
FIG. 7 is a view from below of the discharger upper stationary plate, after removal of the tilting plate and the sliding one, along section line VII—VII of FIG. 4.
Figure 8:
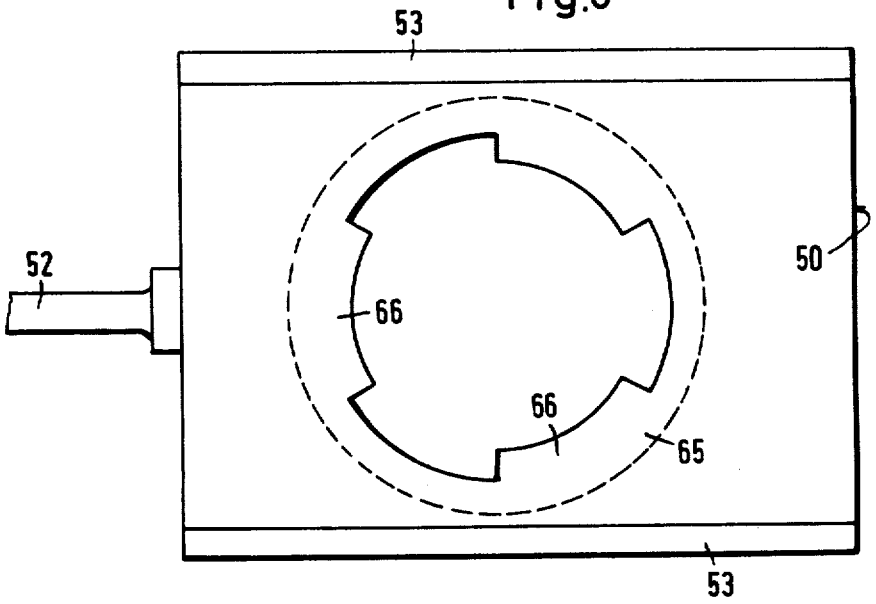
FIG. 8 is a view of the discharger sliding plate along section line VIII—VIII of FIG. 3.

FIG. 9 shows an enlarged cross section of battens 15,16 and 56,57 in FIGS. 6 and 7, correspondingly to the adjustment bolts 17,18 and 58,59.

The bolts or screws are screwed into a threaded hole provided in the corresponding walls of frames 11 and 54 respectively. The bolts project inside the frames with a tang 80 which passes through the battens 15,16 and 56,57, provided at its end with a stop 81, for instance in the form of an elastic ring.

A suitable number of springs 82, preferably cup springs are arranged according to the invention between the batten and the corresponding side of the frame concerned. By tightening the screws, so as to cause the battens to approach the corresponding walls of the associated frame, the springs are compressed. Once arranged in position, the flattened brick 13 or 60 respectively, the screws are rotated to the opposite direction until when the battens rest on the sides of the flattened refractory bricks.

When under the action of heat the flattened refractory brick expands and when on the contrary it restricts, the springs are suitable to assure a perfect adherence between the battens and the brick sides; that, of course, would not be possible in case the battens should have a stationary position adjusted when the associated refractory brick is mounted.

It is to be understood that the invention is not limited to the examples shown. It is intended to cover all modifications and equivalents within the scope of the appended claims.

What we claim is:

1. A box discharger particularly for ladles and the like, of the type comprising, a first metal stationary upper plate fastened onto the bottom of said ladle or the like; a second metal lower plate connected to said upper plate so as to be tiltable from a work position, wherein said tilting plate parallel to said stationary plate to a maintenance position wherein said tilting plate defines with said stationary plate an angle sufficient to allow access to the inside of said discharger; a third metal plate slidable between the first two plates; wherein said three plates each comprises a bore for the passage of a flow of liquid metal when said discharger is in an open position; flattened refractory bricks fastened against the lower face of said upper stationary plate and the upper face of said sliding plate, said flattened refractory bricks sealingly sliding against each other during the discharger movement, said bricks being provided with holes for the passage of the liquid metal when said holes are in registry; the lower face of said tilting lower plate being mounted turnably, a section of annular crown provided on an outer edge of said tilting lower plate with at least two wedgeshaped wings projecting outwards to engage grooves provided on two uprights projecting from the lower face of said stationary upper plate, laterally to the outer profile of said tilting plate; said two uprights, and and driving means provided for rotating said section of annular crown.

2. A box discharger according to claim 1 including ears projecting from a lower face of said stationary plate having slitted holes, and wherein said tilting plate is provided at one of its ends with pins projecting outwards and engaging vertically the slitted holes provided on ears projecting from the lower face of said stationary plate.

3. A box discharger according to claim 1, wherein the outwards projecting wings, provided on the edge of the turnable annular section on the lower face of said refractory plate, engage corresponding wedge-like wings projecting from uprights arranged on the lower face of said stationary plate outside the profile of the tilting plate.

4. A box discharger according to claim 1, wherein on the lower face of said stationary plate and the upper face of said sliding plate are disengageably mounted, two substantially rectangular frames comprising inside said two flattened refractory bricks bored at their center; said rectangular frames being mounted to and dismounted from a working position, in contact with the lower face of said stationary plate and the upper face of said sliding plate respectively, together with corresponding flattened refractory bricks, when said tilting plate is moved to is maintenance position, and angularly displaced with respect to said upper stationary plate.

5. A box discharger according to claim 4, wherein the thickness of said flattened refractory bricks is larger than the one of said frames.

6. A box discharger according to claim 4, wherein each of said support frames for said flattened refractory bricks comprises inside, parallel to two orthogonal sides, two battens which pressed against the edges of said flattened refractory brick inserted inside the frame; to recover the dimensional tolerances of said brick with respect to the fixed size of the inner profile of said frame.

7. A box discharger to claim 4, including screw means screwed into a threaded bore provided in the frame thickness; said screw means further comprising a cylindric tang projecting inside said frame and passing partly through the thickness of the associated batten, said tang further comprising at its inner end locking means preventing it from slipping off, said locking means comprising elastic means between the inner wall of said frame and the outer face of said batten around said tang arranged to push said batten away from the inner wall of said frame.

8. A box discharger according to claim 7, wherein said elastic means consist of cup springs.

* * * * *